US008517514B2

(12) United States Patent
Dietl

(10) Patent No.: US 8,517,514 B2
(45) Date of Patent: Aug. 27, 2013

(54) PRINTHEAD ASSEMBLY AND FLUIDIC CONNECTION OF DIE

(75) Inventor: Steven J. Dietl, Ontario, NY (US)

(73) Assignee: Eastman Kodak Company, Rochester, NY (US)

( * ) Notice: Subject to any disclaimer, the term of this patent is extended or adjusted under 35 U.S.C. 154(b) by 268 days.

(21) Appl. No.: 13/032,664

(22) Filed: Feb. 23, 2011

(65) Prior Publication Data

US 2012/0212540 A1 Aug. 23, 2012

(51) Int. Cl.
*B41J 2/14* (2006.01)
*B41J 2/16* (2006.01)

(52) U.S. Cl.
USPC ..... 347/49; 347/50

(58) Field of Classification Search
USPC ..... 347/40, 42, 43, 59, 65, 70, 71, 49–50, 347/5, 717
See application file for complete search history.

(56) References Cited

U.S. PATENT DOCUMENTS

| | | | | |
|---|---|---|---|---|
| 4,935,750 | A | 6/1990 | Hawkins | |
| 5,581,284 | A * | 12/1996 | Hermanson | 347/43 |
| 2008/0149024 | A1 | 6/2008 | Petruchik et al. | |
| 2008/0158298 | A1 | 7/2008 | Serbicki et al. | |
| 2008/0202694 | A1 | 8/2008 | Serbicki et al. | |
| 2008/0291234 | A1 | 11/2008 | Shimomura et al. | |

FOREIGN PATENT DOCUMENTS

| | | |
|---|---|---|
| EP | 1 946930 | 1/2008 |
| WO | 2011/019529 | 2/2011 |

* cited by examiner

*Primary Examiner* — Thinh Nguyen
(74) *Attorney, Agent, or Firm* — Peyton C. Watkins

(57) ABSTRACT

An inkjet printhead includes a printhead die including an array of nozzles disposed along a nozzle array direction on a first surface, and an ink feed opening disposed on a second surface opposite the first surface, the ink feed opening being fluidically connected to the array of nozzles; a printhead chassis including an ink inlet port; a manifold affixed to the printhead chassis, the manifold including an ink outlet and an ink path that is fluidically connected to the ink outlet and to the ink inlet port of the printhead chassis; and a gasket that provides a fluidic seal between the ink outlet of the manifold and the ink feed opening of the printhead die.

28 Claims, 15 Drawing Sheets

PRINTHEAD ASSEMBLY AND FLUIDIC CONNECTION OF DIE

CROSS REFERENCE TO RELATED APPLICATION

Reference is made to commonly assigned, concurrently filed and co-pending U.S. patent application Ser. No. 13/032,667 filed Feb. 23, 2011, entitled: "Method of Assembling an Inkjet Printhead", the disclosure of which is incorporated herein.

FIELD OF THE INVENTION

The present invention relates generally to the assembly of an inkjet printhead, and more particularly to the mechanical protection, electrical interconnection and fluidic connection of the printhead die.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the nozzle, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

Drop ejector arrays (sometimes interchangeably called nozzle arrays herein) are typically fabricated on printhead die at the wafer scale using integrated circuit and MEMS (microelectrical-mechanical systems) fabrication techniques. Printhead die for some types of inkjet printing technologies, such as thermal inkjet, can include integrated logic and driver circuitry as well as drop ejector arrays, bond pads for electrical interconnection, and an ink feed opening for each separate drop ejector array. The microelectronic and microfluidic packaging of a printhead die into a printhead assembly includes electrical interconnection to facilitate providing signals and power to the small bond pads on the printhead die; mechanical and environmental protection for the printhead die and the electrical interconnections; provision of alignment features to facilitate alignment of the small drop ejectors in the printer for good image quality; and fluidic connection to facilitate providing ink from relatively large ink supplies to relatively small ink feed openings on the printhead die. In other words, much of the printhead assembly facilitates interfacing with small and fragile features of the printhead die, so that the printhead can be readily and reliably installed and used in the printer, even by an untrained user.

A typical early step of printhead assembly is the adhesive bonding of the one or more printhead die to a mounting member using a precisely dispensed adhesive that provides ink resistant fluidic seal(s) between one or more ink feed openings on the one or more printhead die to corresponding opening(s) on the mounting member. Commonly assigned U.S. Patent Application Publication No. 2008/0149024, incorporated herein by reference, discloses a mounting member (made of ceramic, for example) that is insert molded into a substrate. The mounting member includes fluid channels, each of which provides fluid to a corresponding array of drop ejectors. Commonly assigned U.S. Patent Application Publication No. 2008/0202694, incorporated herein by reference, discloses a bismaleimide-containing adhesive sealant for bonding an inkjet printhead die to a mounting member.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if evaporation of volatile components in the vicinity of the nozzle causes the viscosity to increase too much. The maintenance station of the printer typically includes a cap that surrounds the printhead die nozzle face during periods of nonprinting in order to inhibit evaporation of the volatile components of the ink, and also to provide protection against accumulation of particulates on the nozzle face. The maintenance station also typically includes a wiper for wiping the nozzle face to clean off ink residue and other debris.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead is moved by the carriage in a carriage scan direction that is substantially perpendicular to the media advance direction as the drops are ejected from the nozzles. After the printhead has printed a swath of the image while traversing the recording medium, the recording medium is advanced, the carriage direction of motion is reversed, and the image is formed swath by swath.

In an inkjet printer, the face of the printhead die containing the nozzle array(s) is typically positioned near the recording medium in order to provide improved print quality. Close positioning of the nozzle face of the printhead die to the recording medium keeps the printed dots close to their intended locations, even for angularly misdirected jets. Typically the nozzle face is recessed slightly below other features, such as encapsulation. Electrical interconnection to the bond pads on the printhead die is provided by wire bonding or tape automated bonding to a flexible printed wiring member. The electrical interconnections must be protected mechanically and environmentally for long-term reliability of the printhead. Flow of the encapsulant for the electrical interconnections must be carefully controlled before curing in order to provide a low profile printhead face that allows close positioning and good maintainability of the nozzle face. An encapsulation process for printhead die electrical interconnections is disclosed in commonly assigned U.S. Patent Application No. 2008/0158298, incorporated herein by reference.

Although the typical printhead assembly configuration and method is suitable in many applications, there is a need to provide improved control of encapsulant near the nozzle face, to use fewer different materials, and to eliminate relatively expensive components and processes, such as the ceramic mounting member for the printhead die, as well as precision dispensing of adhesive.

SUMMARY OF THE INVENTION

The present invention is directed to overcoming one or more of the problems set forth above. Briefly summarized, according to one aspect of the invention, the invention resides in an inkjet printhead comprising a printhead die including an array of nozzles disposed along a nozzle array direction on a first surface, and an ink feed opening disposed on a second surface opposite the first surface, the ink feed opening being fluidically connected to the array of nozzles; a printhead chassis including an ink inlet port; a manifold affixed to the printhead chassis, the manifold including an ink outlet and an ink path that is fluidically connected to the ink outlet and to the ink inlet port of the printhead chassis; and a gasket that provides a fluidic seal between the ink outlet of the manifold and the ink feed opening of the printhead die.

DETAILED DESCRIPTION OF THE INVENTION

Figure 1:
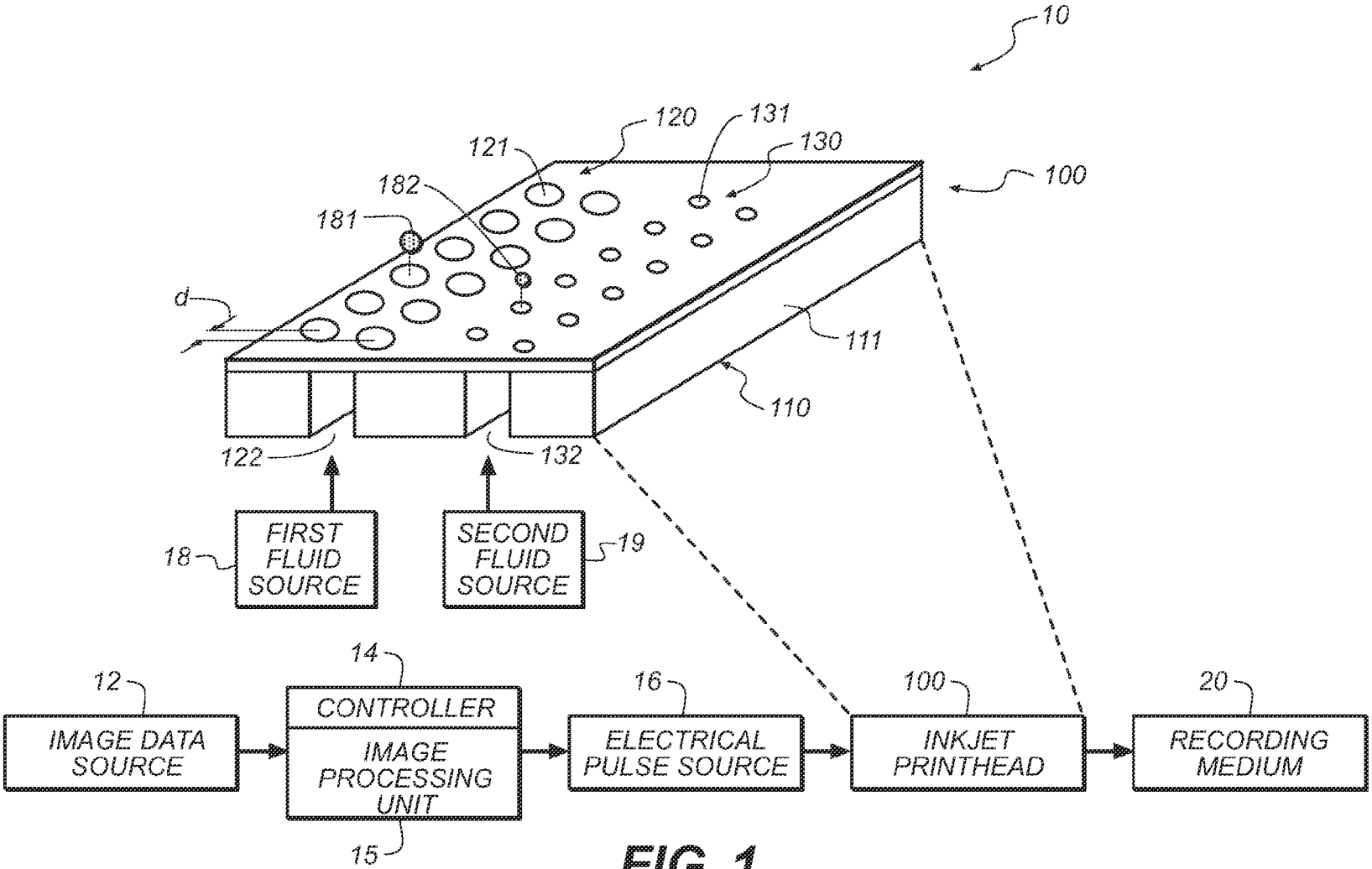
FIG. 1 is a schematic representation of an inkjet printer system.

Referring to FIG. 1, a schematic representation of an inkjet printer system 10 is shown, for its usefulness with the present invention and is fully described in commonly assigned U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays (sometimes called drop ejector arrays herein) disposed at a surface of inkjet printhead die 110. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown schematically in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles to form drop ejectors. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
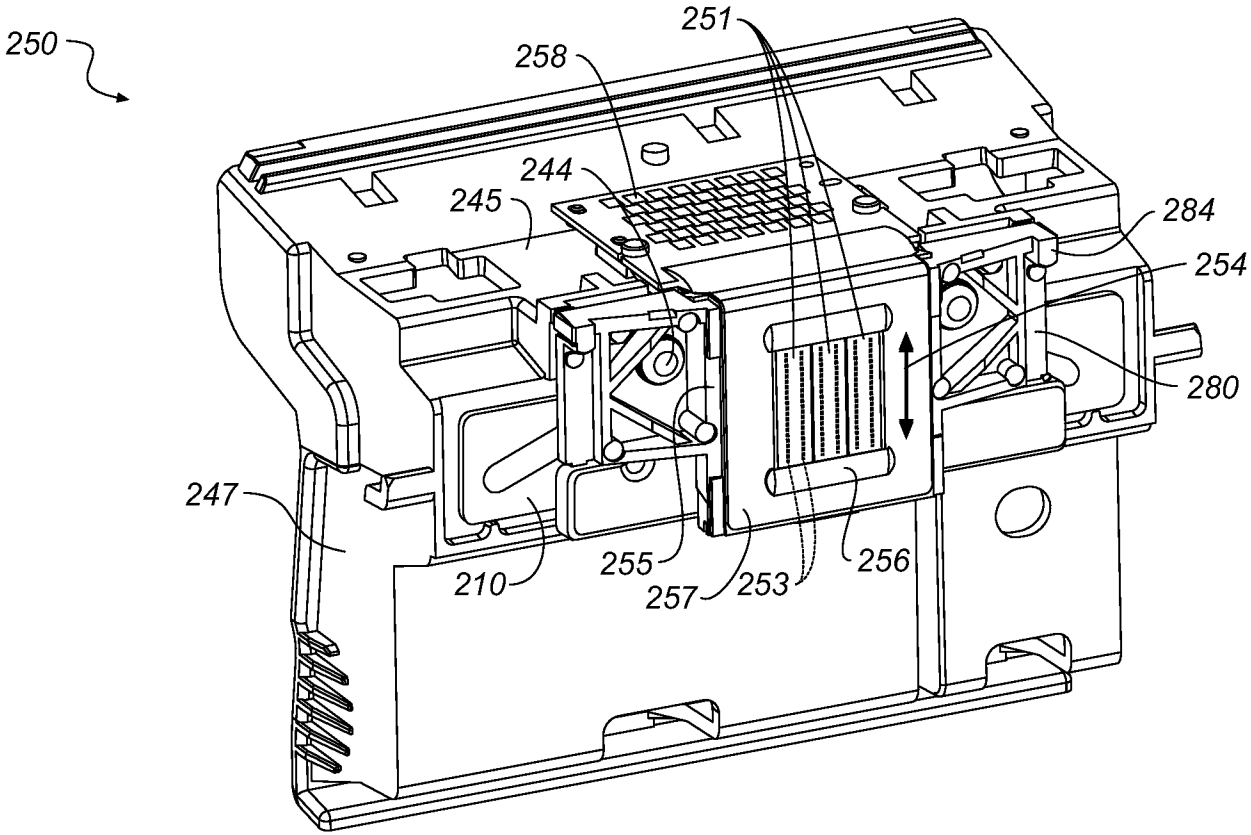
FIG. 2 (PRIOR ART)
FIG. 2 is a perspective view of a portion of a printhead including a prior art mounting assembly.

FIG. 2 shows a perspective view of a portion of a printhead 250, which is an example of an inkjet printhead 100. Printhead 250 includes three printhead die 251 (similar to printhead die 110 in FIG. 1) that are affixed to a prior art mounting substrate 255, which is part of a prior art mounting assembly 280 attached to printhead chassis 247, for example by screws 244. Mounting assembly 280 includes alignment features 284 to facilitate accurate positioning of the printhead 250 in the printer. Each printhead die 251 contains two nozzle arrays 253, so that printhead 250 contains six nozzle arrays 253 altogether. The six nozzle arrays 253 in this example are each be connected to ink sources (not shown in FIG. 2), such as cyan, magenta, yellow, text black, photo black, and protective fluid. Manifold 210 is affixed to printhead chassis 247 (for example by laser welding) and brings ink from the widely spaced ink sources to the more narrowly spaced ink feed openings in the printhead die 251.

Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flexible printed wiring member 257 to which the printhead die 251 are electrically interconnected, for example, by wire bonding or tape automated bonding. Flexible printed wiring member 257 is also adhered to mounting substrate 255, and surrounds the printhead die 251. The interconnections are covered by an encapsulant 256 to protect them. Flexible printed wiring member 257 bends around an edge of printhead chassis 247 and connects to connector board 258 on rear side 245. When printhead 250 is mounted into the carriage 200 (see FIG. 3), connector board 258 is electrically connected to a connector on the carriage 200, so that electrical signals can be transmitted to the printhead die 251.

In embodiments of the present invention, prior art mounting assembly 280 (FIG. 2) of printhead 250 is replaced by a support structure which is overmolded on the printhead die and the flexible printed wiring member, as will be described in more detail below.

Figure 3:
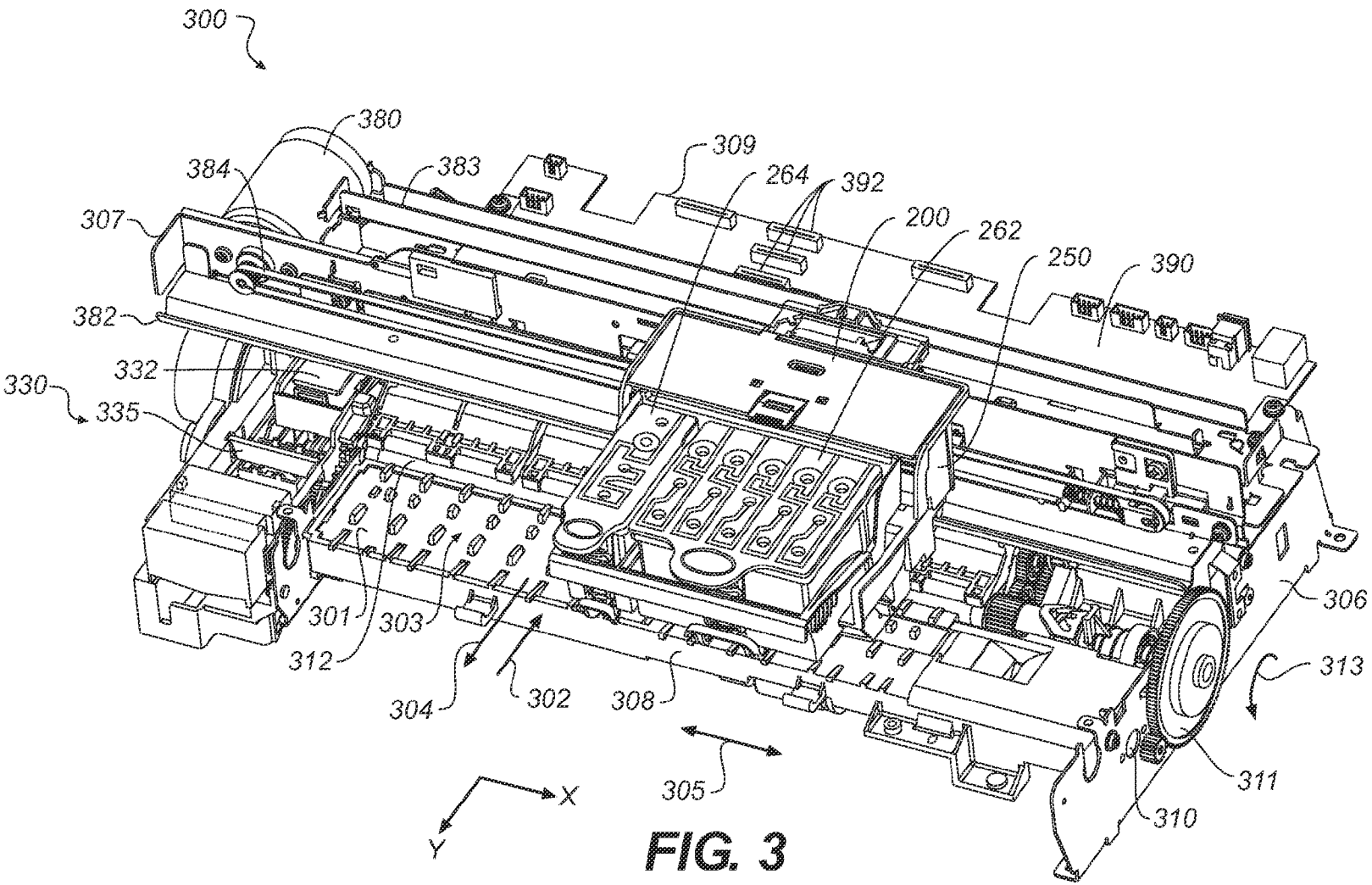
FIG. 3 is a perspective view of a portion of a carriage printer.

FIG. 3 shows a portion of a desktop carriage printer that can be used either for the prior art printhead configuration of FIG. 2, or for the printhead of the present invention. Some of the parts of the printer have been hidden in the view shown in FIG. 3 so that other parts can be more clearly seen. Printer chassis 300 has a platen 301 in print region 303 across which carriage 200 is moved back and forth in carriage scan direction 305 between the right side 306 and the left side 307 of printer chassis 300, while drops are ejected from printhead die 251 (not shown in FIG. 3) on printhead 250 that is mounted on carriage 200. Carriage 200 typically includes datum features to align the printhead 250 in the printer. Paper or other recording medium is held substantially flat against platen 301, although sometimes an edge of the recording medium lifts away from platen 301. Carriage motor 380 moves belt 384 to move carriage 200 along carriage guide rail 382. An encoder sensor (not shown) is mounted on carriage 200 and indicates carriage location relative to an encoder fence 383.

The mounting orientation of printhead 250 is rotated relative to the view in FIG. 2, so that the printhead die 251 are located at the bottom side of printhead 250, the droplets of ink being ejected downward onto the recording medium in print region 303 in the view of FIG. 3. Multi-chamber ink tank 262, in this example, contains five ink sources: cyan, magenta, yellow, photo black and colorless protective fluid; while single-chamber ink tank 264 contains the ink source for text black. Ink tanks 262 and 264 can include electrical contacts (not shown) for data storage devices, for example, to track ink usage. In other arrangements, rather than having a multi-chamber ink tank to hold several ink sources, all ink sources are held in individual single chamber ink tanks. Paper or other recording medium (sometimes generically referred to as paper or media herein) is loaded along paper load entry direction 302 toward the front of printer chassis 308.

Figure 4:
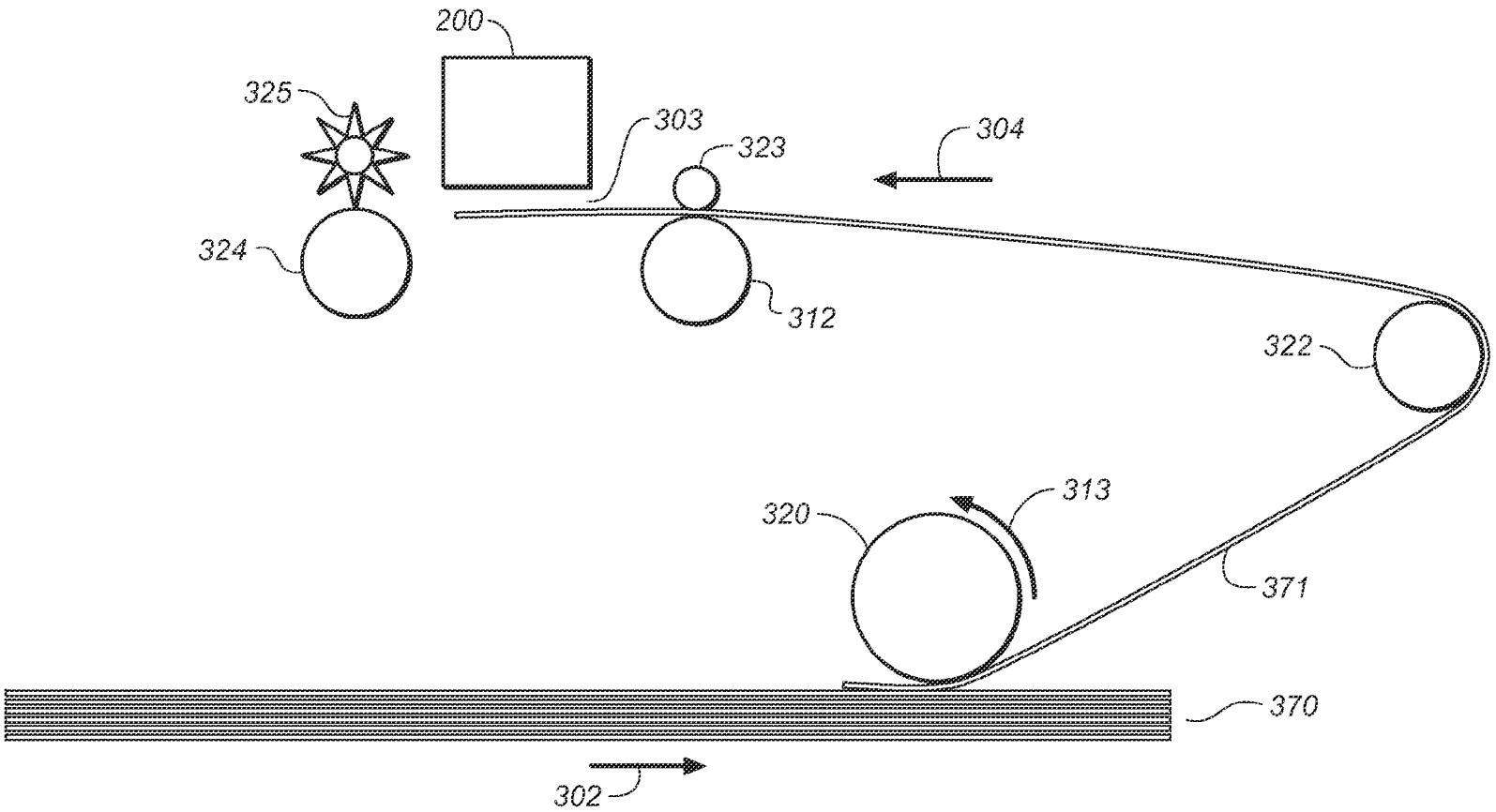
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance across print region 303 (platen not shown), and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330 including a cap 332 and a wiper 335.

Toward the rear of the printer chassis 309, in this example, is located the electronics board 390, which includes cable connectors 392 for communicating via cables (not shown) to the printhead carriage 200 and from there to the printhead 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 5:
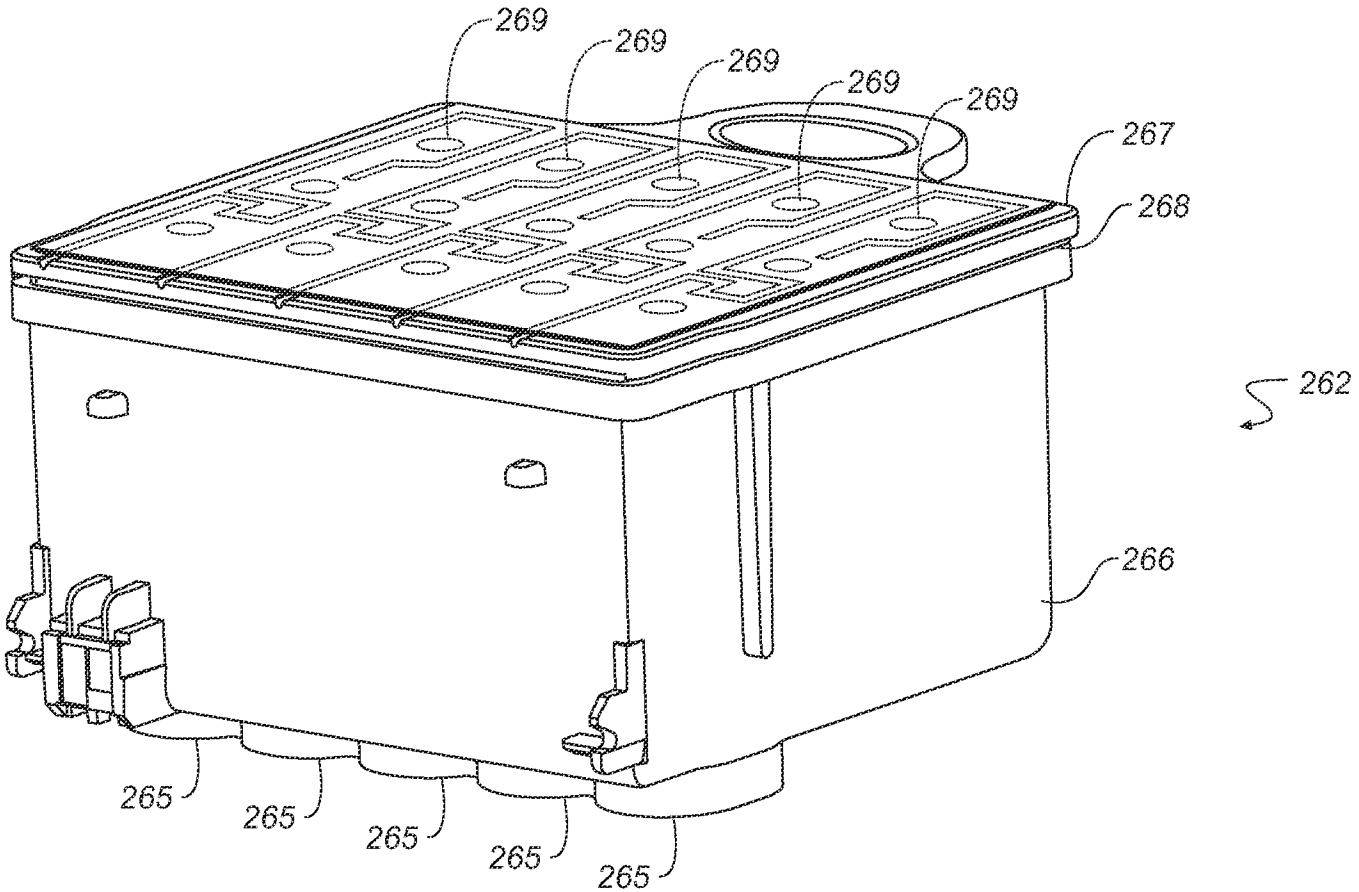
FIG. 5 is a perspective view of multichamber ink supply.

FIG. 5 shows a perspective view of multi-chamber ink supply 262 removed from printhead 250. Multi-chamber ink supply 262 includes a supply body 266 and a lid 267 that is sealed (e.g. by welding) to ink supply body 266 at lid sealing interface 268. Lid 267 individually seals all of the chambers 269 in the ink supply. In the example shown in FIG. 5, multi-chamber ink supply 262 has five chambers 269 below lid 267, and each chamber has a corresponding ink supply port 265 that is used to transfer ink to the printhead die 251. As shown in FIG. 3, the ink supplies 262 and 264 are mounted on the carriage 200 of printer chassis 300, such that the lid 267 is at an upper surface, and correspondingly ink supply ports 265 are at a lower surface.

Figure 6:
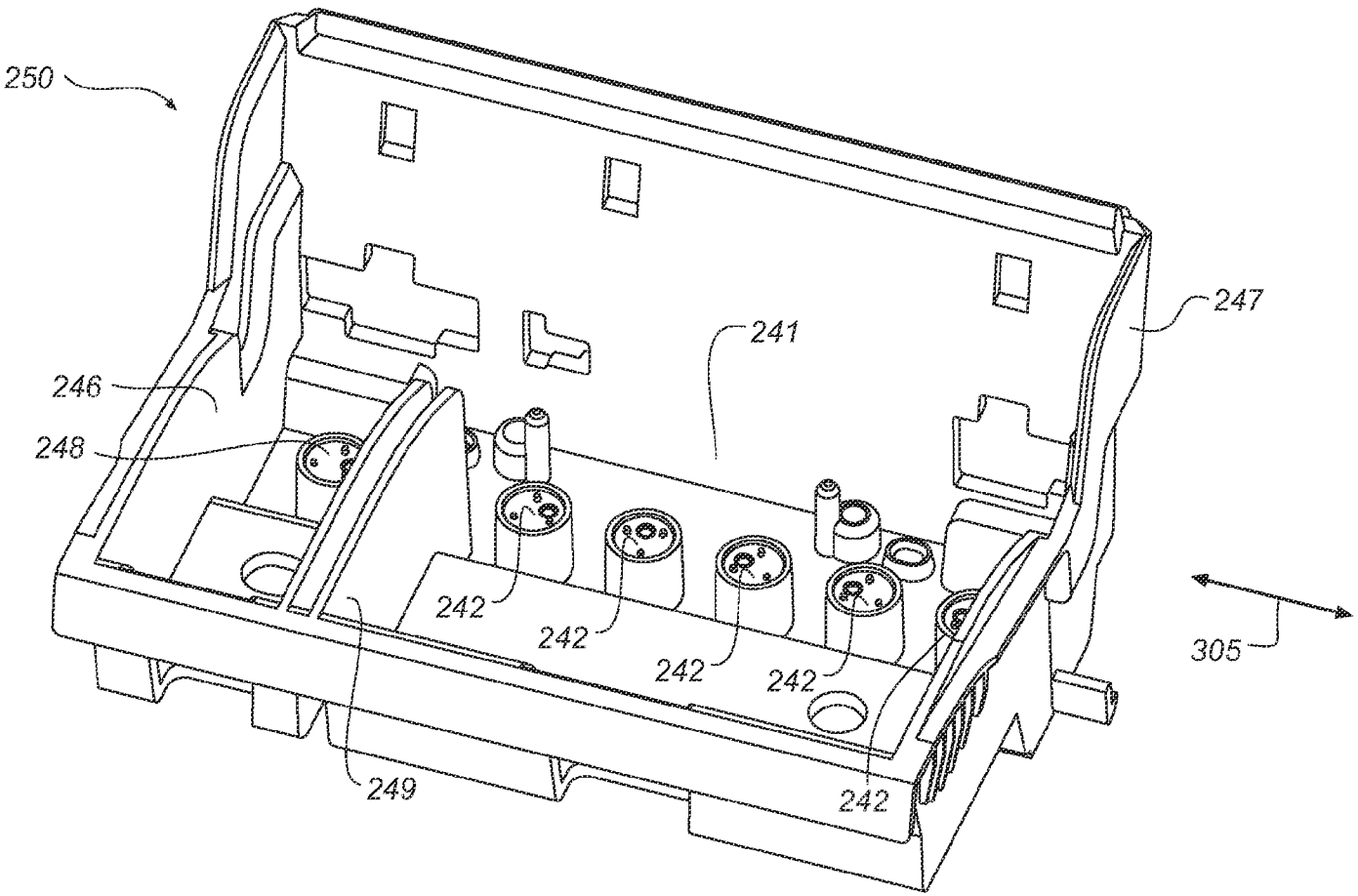
FIG. 6 is a perspective view of a printhead chassis into which ink supplies can be installed.

FIG. 6 shows a top perspective view of printhead chassis 247 of printhead 250 without either detachable ink supply 262 or 264 mounted in it. Multi-chamber ink supply 262 is mountable in a multi-chamber ink supply region 241 and single-chamber ink supply 264 is mountable in a single-chamber ink supply region 246 of printhead 250. Multi-chamber ink supply region 241 is separated from single-chamber ink supply region 246 by partitioning wall 249, which can also help guide the ink supplies during insertion. Five multi-chamber ink inlet ports 242 are shown in multi-chamber ink supply region 241 that connect with ink supply ports 265 of multi-chamber ink supply 262 when it is installed, and one single-chamber ink inlet port 248 is shown in single-chamber ink supply region 246 for the ink supply port on the single-chamber ink supply 264. When an ink supply is installed in the printhead 250, it is in fluid communication with the printhead because of the connection of ink supply port 265 with ink inlet 242 or 248. The printhead chassis 247 of FIG. 6 can be used either with the prior art configuration of FIG. 2, or with the configuration described below relative to the present invention.

Figure 7:
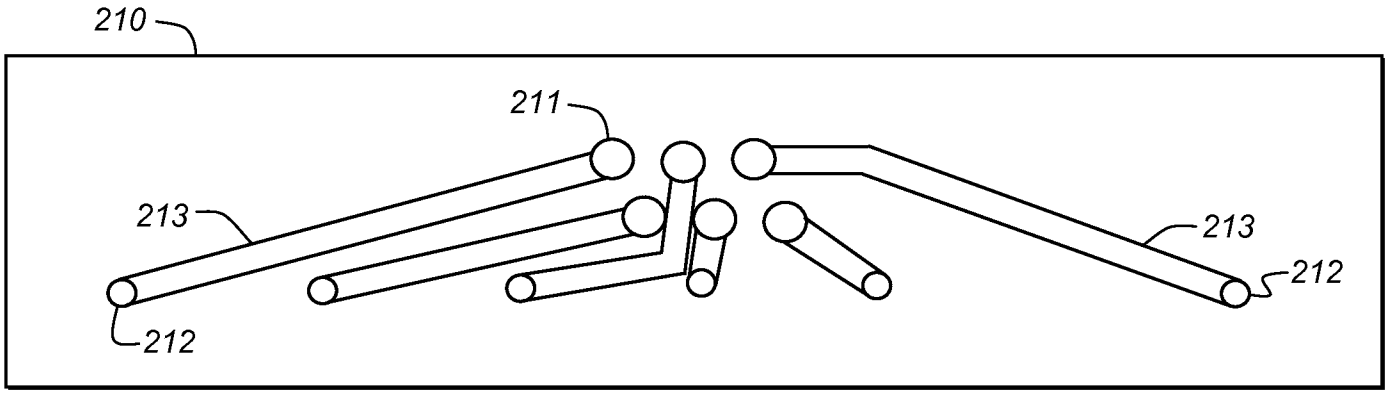
FIG. 7 is a bottom view of a manifold for providing ink paths between the wide spacing of ink supply ports on the ink supplies and the narrow spacing of ink feed openings for nozzle arrays.

In order to provide sufficient capacity for storing ink, the ink chambers 269 (FIG. 5) are typically wider than the spacing between nozzle arrays on the printhead die, so that connection ports 242 and 248 are not directly in line with ink feed openings on the printhead die. FIG. 7 shows a bottom view (rotated slightly from the orientation of FIG. 2) of a manifold 210 that provides ink paths from ink inlet ports 242 and 248 to the spacing of the ink feed openings on the printhead die. In the example of FIG. 7, manifold 210 includes six manifold ink outlets 211 that provide ink respectively to the nozzle arrays on the printhead die. A first ink inlet port 242 or 248 is typically separated from a second ink inlet port 242 or 248 of printhead chassis by a distance that is greater than a distance between the corresponding second ink outlet 211 and first ink outlet 211. Manifold ink outlets 211 can be tube-shaped extensions, for example. Ink enters manifold 210 at manifold entry ports 212, which are fluidically connected to ink inlet ports 242 and 248 at a face opposite the face where the ink supply ports 265 contact (FIGS. 5 and 6). Manifold ink paths 213 are provided to bring ink from a manifold entry port 212 to a corresponding manifold ink outlet 211. Thus, manifold ink paths 213 are fluidically connected to manifold ink outlets 211 and corresponding ink inlet ports 242 and 248 on printhead chassis 247. Manifold 210 can be used to provide ink to the mounting substrate 255 of the prior art configuration of FIG. 2 or directly with the ink feed openings in the printhead die as described below relative to the present invention.

Figure 8:
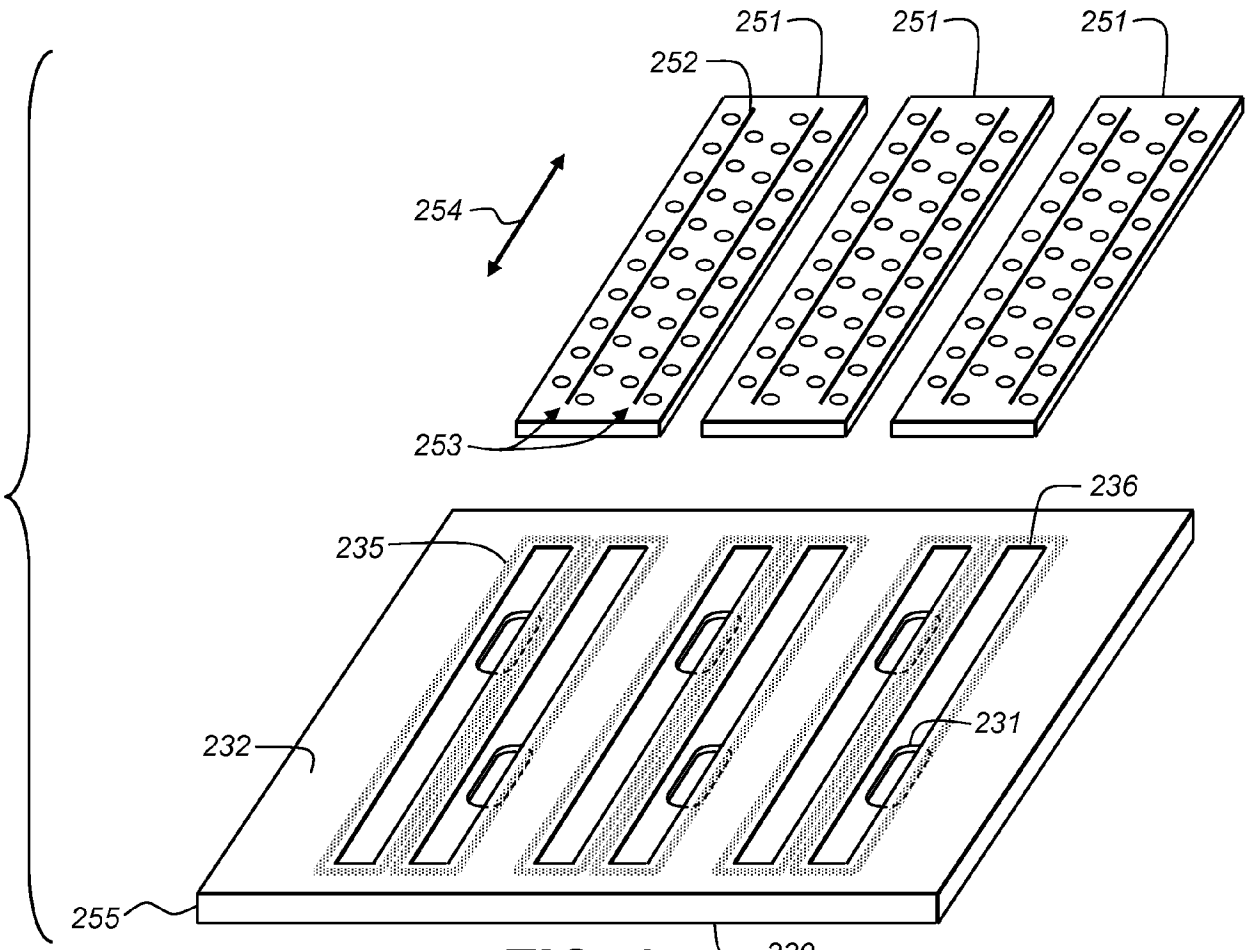
FIG. 8 (PRIOR ART)
FIG. 8 is a nozzles-up view of a prior art configuration of printhead die and mounting substrate.
Figure 9:
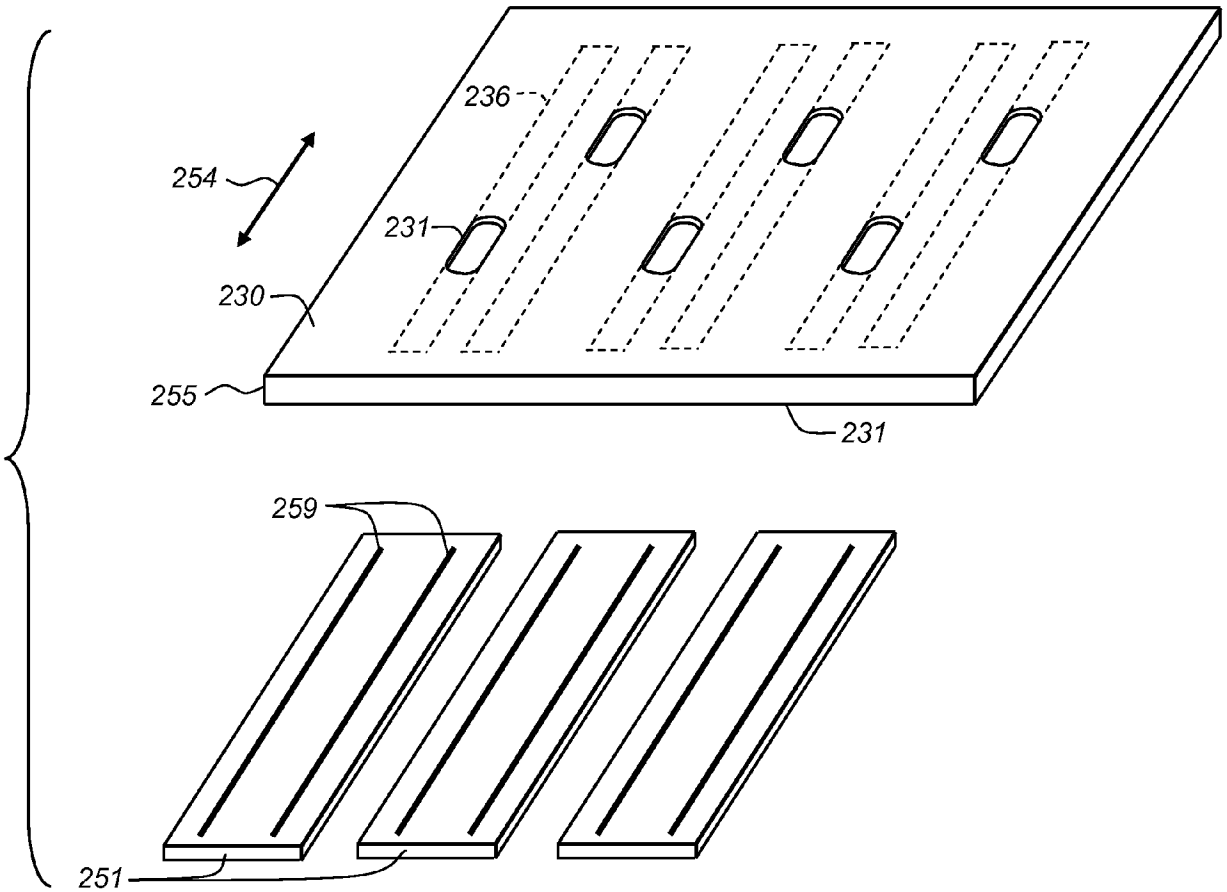
FIG. 9 (PRIOR ART)
FIG. 9 is a nozzles-down view of the prior art configuration shown in FIG. 8.

FIGS. 8 and 9 show typical examples of printhead die 251 in relation to a prior art mounting substrate 255. In the nozzles-up view of FIG. 8, each of the three printhead die 251 are shown with nozzle arrays 253 and corresponding ink feeds 252 disposed along nozzle array direction 254. The mounting substrate 255 is shown with elongated openings 236 on die attach surface 232. Die bond adhesive 235 is precisely deposited around each of the elongated openings 236 in order to provide adhesive bonding for the printhead die 251, as well as to provide separated fluidic seals corresponding to the ink feeds 252 of each nozzle array 253. In the nozzles-down view of FIG. 9, elongated ink feed openings 259 of printhead die 251 are seen. The die bond adhesive 235 (FIG. 8) surrounds each elongated ink feed opening 259 when the printhead die 251 are adhesively attached to mounting substrate 255. Also shown are ink entry openings 231 on the ink entry surface 230 of mounting substrate 255. The ink entry openings 231 are staggered with respect to each other and are smaller than the elongated openings 236. In this way, the ink entry openings 231 on mounting member 255 can be readily sealed to the corresponding manifold ink outlets 211 of manifold 210, even though the elongated ink feed openings 259 corresponding to nozzle arrays 253 on printhead die 251 are closely spaced in order to keep the size and cost of the printhead die 251 relatively low.

Figure 10:
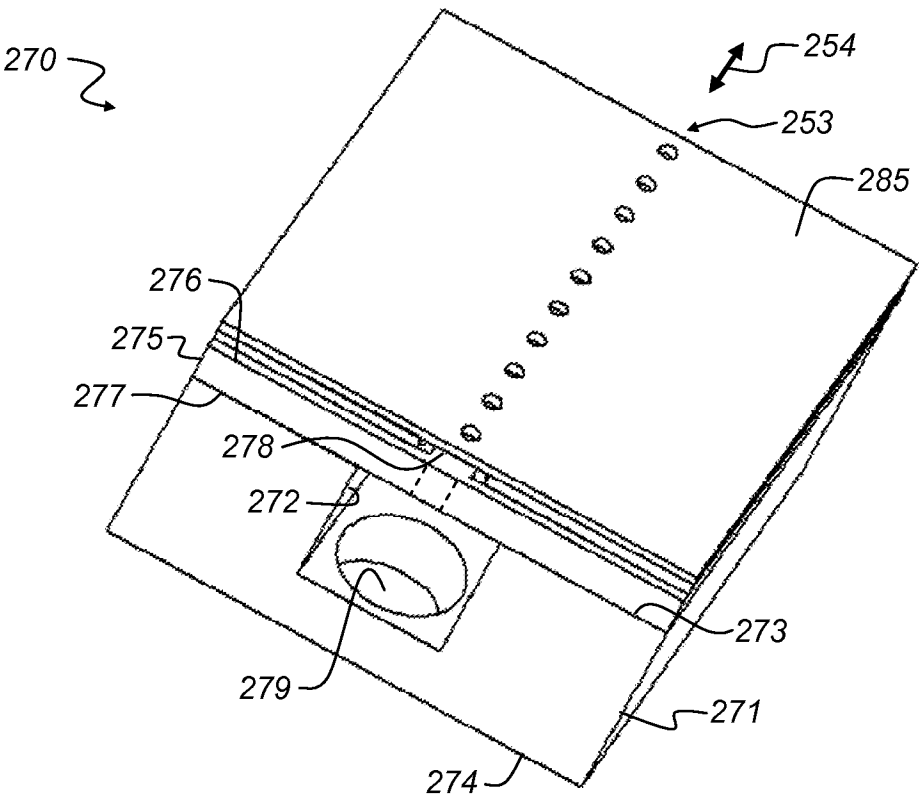
FIG. 10 is a perspective view of a printhead die having an ink feed configuration that can be advantageously used in the present invention.

In embodiments of the present invention, it is desired to save further cost by eliminating the mounting substrate 255 and die bond adhesive 235. For printhead die having closely spaced nozzle arrays, one way to facilitate sealing the ink opening in the printhead die directly to the manifold with a gasket, is to fabricate small staggered ink feed openings in the printhead die. Commonly assigned U.S. patent application Ser. No. 12/768,754, entitled "Inkjet Printhead Device with Composite Substrate", incorporated herein by reference, discloses a way to fabricate small openings on the side of the printhead die opposite the nozzle arrays. A portion of a printhead die 270 having a composite substrate is shown in FIG. 10. A planar substrate 271 is provided including a first interface surface 273, a second surface 274 opposite first interface surface 273, and a channel 272 formed at the first interface surface 273. A planar semiconductor member 275 having a first surface 276 and a second interface surface 277 is fused to the planar substrate 271. In particular, first interface surface 273 of planar substrate 271 is fused to second interface surface 277 of planar semiconductor member 275. A variety of thin film layers (not labeled in FIG. 10) including dielectric layers, metal layers, one or more chamber layers and a nozzle plate are formed on first surface 276 of planar semiconductor member 275 to form one or more nozzle arrays 253 along with associated drop forming mechanisms and electronics. Nozzle arrays 253 are formed at a nozzle face surface 285 with the nozzle array direction 254 being along the same direction that channel 272 extends, so that channel 272 can provide ink to nozzle array 253 along ink passageway 278 that is formed partially in planar semiconductor member 275 (as indicated by dashed lines) and partly in the thin film layers on the first surface 276. A small ink feed opening 279 is formed from second surface 274 of planar substrate 271 to channel 272 and is fluidically connected to nozzle array 253 via channel 272 and ink passageway 278. (The word "small" is used to indicate that the ink feed opening 279 is significantly smaller than the length of channel 272. Typically no dimension of the ink feed opening 279 is larger than 20% of the length of nozzle array 253.) Only a portion of printhead die 270 is shown in FIG. 10. Typically at least one additional nozzle array 253 would be formed along nozzle array direction 254 and offset from the nozzle array shown in FIG. 10 along a direction that is perpendicular to nozzle array direction 254. Typically the nozzle arrays 253 have substantially equal nozzle array lengths along nozzle array direction 254. A channel 272 would be similarly formed in planar substrate 271 to feed that nozzle array 253 via a corresponding ink passageway 278, and a small ink feed opening 279 would be formed from second surface 274 to that channel. The small ink feed openings 279 would preferably be staggered in order to facilitate fluidic sealing of closely spaced nozzle arrays 253 to the manifold as described above relative to FIG. 9 for the prior art mounting substrate 255. Typically the second ink feed opening 279 is displaced from the first ink feed opening 279 by a distance that is less than 50% of the nozzle array length along nozzle array direction 254 and by a distance that is less than 30% of the nozzle array length in a direction perpendicular to the nozzle array direction. Planar substrate 271 and planar semiconductor member 275 can both be made of silicon, for example.

In some embodiments the spacing between adjacent ink feed openings and the sealing techniques for providing fluidic seals to those ink feed openings are such that it is not required to provide small ink feed openings on the printhead die as described above relative to FIG. 10. In such embodiments the ink feed openings on the printhead die can be elongated slots, similar to the elongated ink feed openings 259 shown in FIG. 9.

FIGS. 11 to 15 illustrate some of the details of an inkjet printhead assembly with a direct seal between a printhead die (such as printhead die 270 described above) and a manifold without adhesively bonding the printhead die to a mounting substrate using precisely dispensed adhesives around an ink opening in the printhead die, according to embodiments of the present invention.

Figure 11:
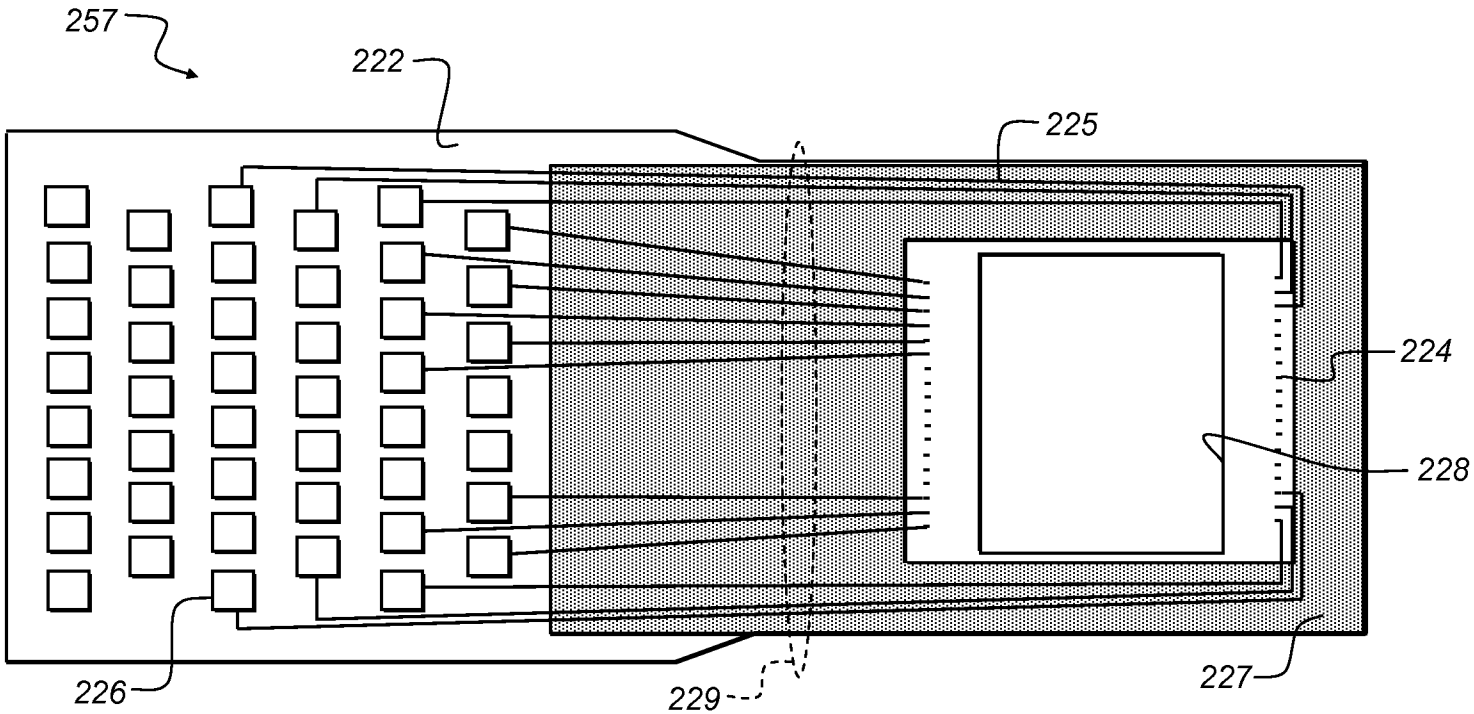
FIG. 11 is a schematic top view of a flexible printed wiring member.

FIG. 11 shows a top view of flexible printed wiring member 257. In the configuration of FIG. 11, the connector board 258 of FIG. 2 has been incorporated into the flexible printed wiring member 257 rather than being a discrete part. Wiring portions including a plurality of leads 225 (not all of which are shown), as well as a corresponding plurality of contact pads 224 at a die interconnect portion and connector pads 226 at a connector portion, have been patterned in a copper layer on a flexible base layer 222 such as polyimide. A nickel layer is typically plated over the copper, and a gold layer is typically plated over the nickel, particularly at the contact pads 224 (for good wire bondability) and at the contact pads 224 (for reliable connection to the connector at the carriage). A cover layer 227 is shown as a translucent gray shaded region. Cover layer 227 is typically laminated over the leads prior to gold plating, so that the expensive gold material is only deposited where needed. Cover layer 227 is typically thin (on the order of 0.03 mm). The entire thickness of flexible printed wiring member 257 is on the order of 0.1 mm, so that it is readily bent in bend region 229 (see also FIG. 2 with regard to flexible circuit 257 bending around an edge of printhead 247). For a thin polyimide cover layer 227, leads 225 can typically be seen through the cover layer 227 (as indicated in FIG. 11). Cover layer 227 also provides protection of leads 225 against ink, against inadvertent shorting and/or against mechanical damage. In some arrangements, cover layer 227 extends all the way into the region of the connector pads 226. In such arrangements, cover layer 227 does not cover connector pads 226, but surrounds each one. An opening 228 is provided within flexible printed wiring member 257.

Figure 12:
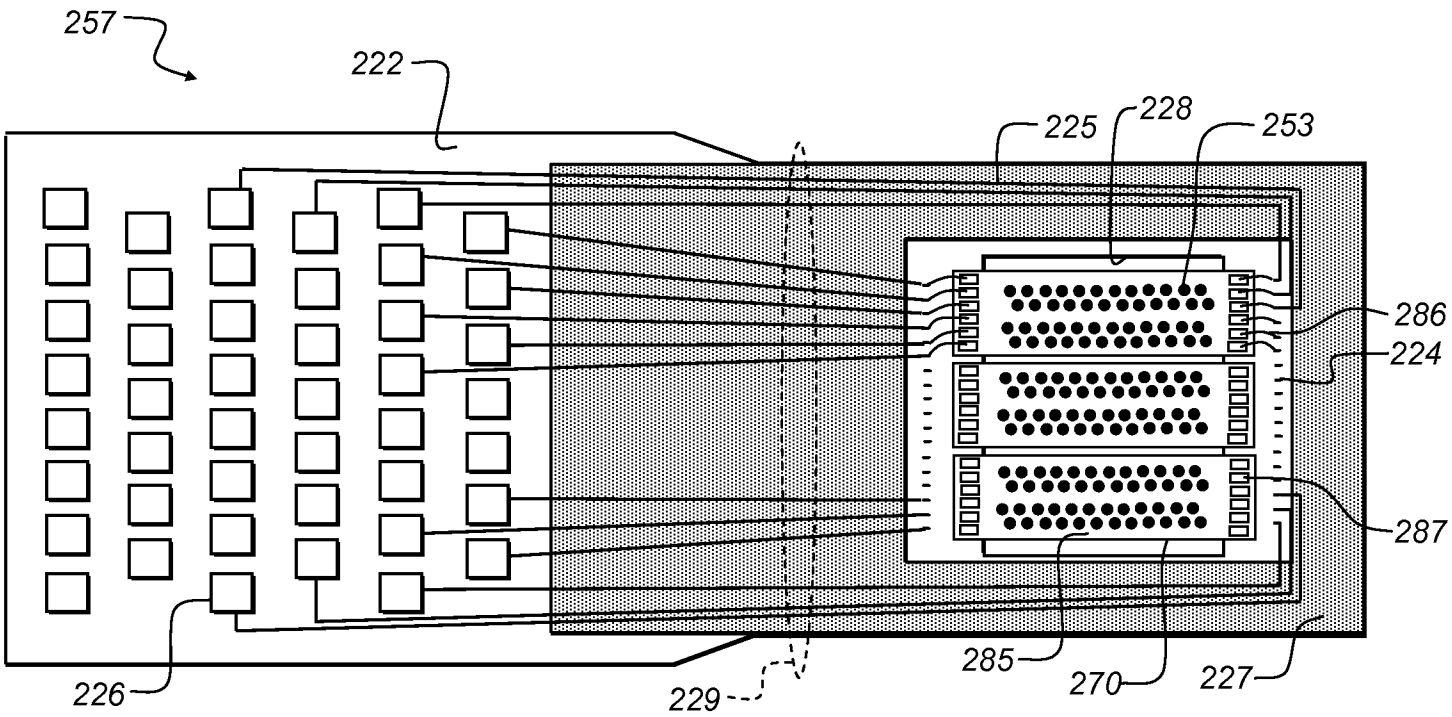
FIG. 12 is a schematic top view of the flexible printed wiring member of FIG. 11, together with printhead die that have been electrically interconnected to it.
Figure 13:
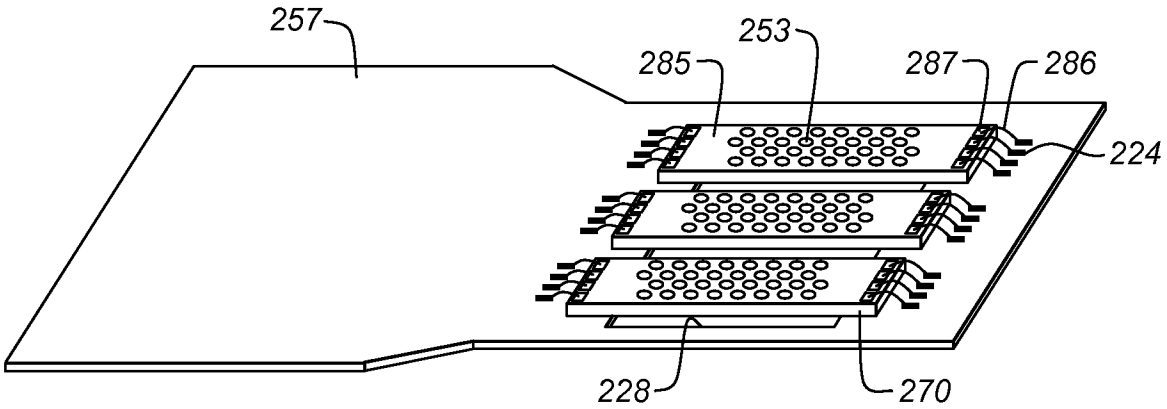
FIG. 13 is a nozzles-up perspective view of the flexible printed wiring member and printhead die of FIG. 12.

FIG. 12 shows a top view and FIG. 13 shows a perspective view of flexible printed wiring member 257 with three printhead die 270 bridging across opening 228. Each of the three printhead die 270 includes two nozzle arrays 253 and their corresponding ink feed openings 279 (FIG. 15) in this example. Nozzle arrays 253 and a plurality of bond pads 287 are shown on nozzle face surface 285. Wire bonds 286 are shown for the uppermost printhead die in FIG. 12 between the bond pads 287 and corresponding contact pads 226 on the flexible circuit 257. Prior to wire bonding, the ends of printhead die 270 can be adhesively bonded to flexible printed wiring member 257 to secure them into position. However, unlike the prior art attaching of printhead die 251 to mounting substrate 255 with die bond adhesive 235 (as described above relative to FIG. 9), the adhesive to bond printhead die to flexible printed wiring member 257 does not need to be precisely dispensed around an ink opening and it does not need to be compatible with the ink because it will be protected by an overmolded structure described below. If tape automated bonding (TAB) is used rather than wire bonding (using leads that cantilever from the flexible printed wiring member), the TAB leads themselves can hold the printhead die 270 in position and no adhesive is required in some such embodiments.

Figure 14:
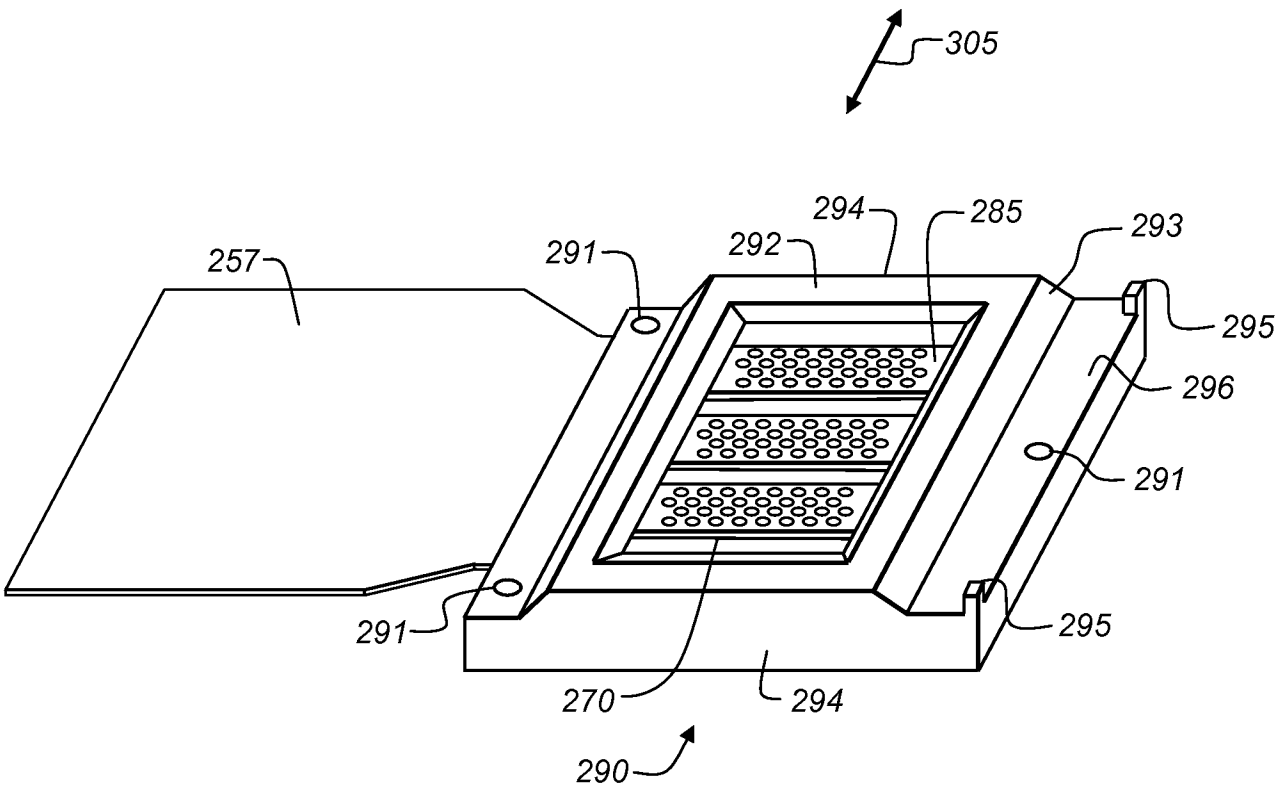
FIG. 14 is a nozzles-up perspective view of the flexible printed wiring member and printhead die of FIG. 13 together with an overmolded support structure according to an embodiment of the invention.

FIG. 14 shows a perspective view (nozzle face up as in FIG. 13) of an overmolded support structure 290 that has been overmolded around the printhead die 270 and a portion of flexible printed wiring 257. In particular, overmolded support structure 290 has been molded to be in contact with nozzle face surface 285, second surface 274 (see FIG. 15) that is opposite nozzle face surface 285, flexible printed wiring member 257, and electrical interconnections (e.g. wire bonds 286) between the printhead die and the flexible printed wiring member 257. The overmolded support structure 290 is molded from an electrically insulating polymer (such as an epoxy molding compound) that is chemically robust and mechanically strong after the molding process is completed. Typically the molding polymer is injected into a molding tool as a liquid and then cured or cooled to form a solid protective structure for the printhead die 270, the flexible printed wiring member 257, and the electrical interconnections (e.g. wire bonds 286).

Overmolded support structure 290 can include attachment features 291 (such as holes for screws, or snap fitting features) that can be formed at the time of molding. Attachment features 291 can be used to affix the overmolded support structure 290 to printhead chassis 247 in a similar way that screws 244 are used to attach mounting assembly 280 to the prior art printhead chassis shown in FIG. 2. Optionally, overmolded support structure 290 can be affixed to manifold 210, which is itself attached to printhead chassis 247, as described above relative to FIG. 2.

Overmolded support structure 290 can also include alignment features 295 that can be formed at the time of molding. Alignment features 295 can be used to accurately position printhead 250 into printer 300 as described above relative to FIGS. 2 and 3 for alignment features 284 on prior art mounting assembly 280 (e.g. with alignment features 295 touching corresponding datum features provided on carriage 200).

In the example shown in FIG. 14, attachment features 291 and alignment features 295 are located in a recessed region 296 of overmolded support structure 290. Inclined region 293 extends "upward" (in the view of FIG. 14) beyond nozzle recessed region 296 and nozzle face surface 285 in order to encapsulate wire bonds 286 (FIG. 13). A flat capping surface 292 is provided by overmolded support structure 290. In the printer, cap 332 of maintenance station 330 (FIG. 3) seals against capping surface 292 during periods of non-printing in order to inhibit the evaporation of volatile components in the ink near the nozzles so that jetting of drops is not degraded. Sealing of cap 332 against capping surface 292 also allows vacuum priming of ink out of nozzles when needed. The distance that capping surface 292 extends beyond nozzle face surface 285 is exaggerated for clarity in FIG. 14. In order for wiper 335 of maintenance station 330 to be able to wipe both the capping surface 292 and the nozzle face surface 285, the capping surface 292 typically extends beyond nozzle face surface 285 by 0.2 mm or less. In the example shown in FIG. 14, inclined region 293 has an inclined surface at the ends of printhead die 270 near wire bonds 286 (FIG. 13). In some configurations, it is also advantageous to provide an inclined surface (from recessed region 296 to capping surface 292) at the scanning lead edges 294. Such an inclined surface can help to protect the nozzle face surface 285 from paper strikes due to dog-eared or raised edges, for example, as the printhead 250 is moved bidirectionally along carriage scan direction 305 beyond the side edges of the paper, as is further described in commonly assigned U.S. Pat. No. 7,862,147, incorporated herein by reference.

Figure 15:
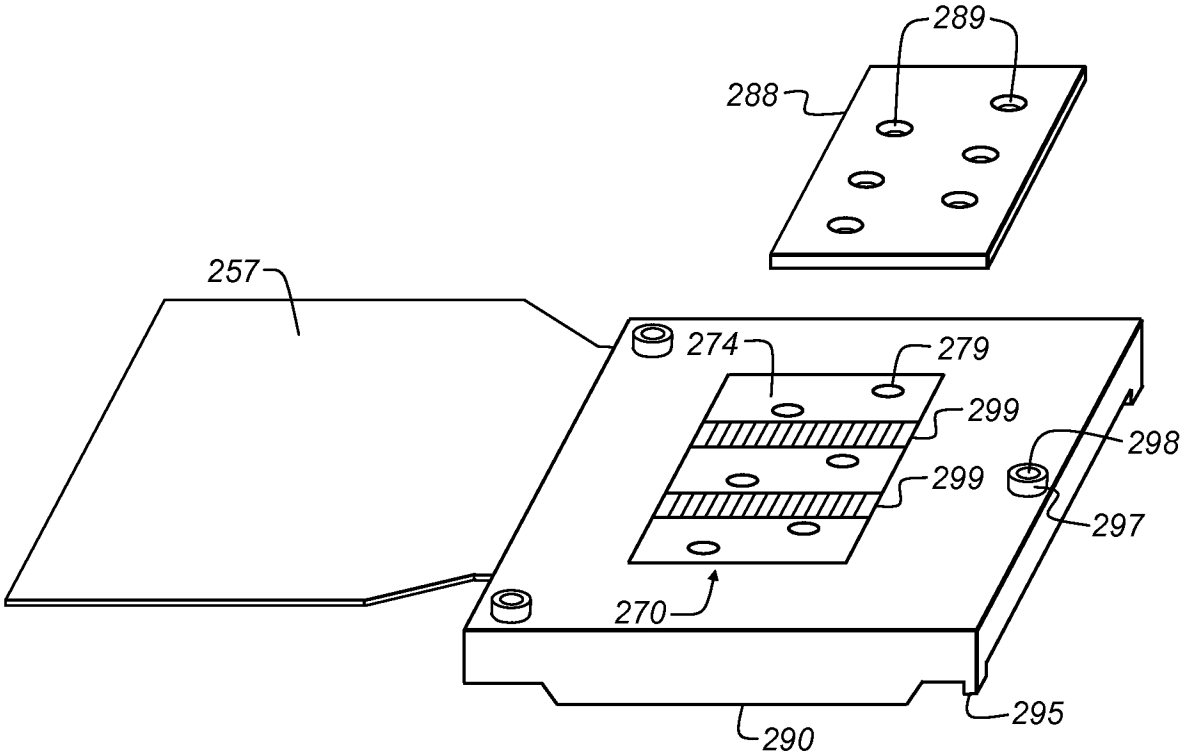
FIG. 15 is a nozzles-down perspective view of the overmolded support structure, flexible printed wiring member, and printhead die of FIG. 14.

FIG. 15 shows the printhead die 270 with flexible printed wiring member 257 and overmolded support structure 290 of FIG. 14, but with nozzles facing down. In this example, each of the three printhead die 270 has small ink feed openings 279 on second surface 274, as described above relative to FIG. 10. The ink feed openings 279 are arranged in a staggered fashion in order to facilitate fluidic sealing to manifold ink outlets 211 of manifold 210 (see FIG. 7). Fluidic sealing between manifold ink outlets 211 and ink feed openings 279 of printhead die 270 can be done by individual O-ring seals for each ink feed opening 279 and corresponding manifold ink outlet 211. Alternatively, a single-piece elastomeric gasket 288 having gasket openings 289 arranged in the same configuration as the ink feed openings 279 and the manifold ink outlets 211 can be used to provide the fluidic seal. Spacers 297 can be provided to control the amount of compression of gasket 288 when overmolded support structure 290 is affixed to printhead chassis 247 facing manifold 210. Spacers 297 are adjacent manifold 210 when the printhead 250 is assembled. In the configuration shown in FIG. 15, spacers 297 are formed during molding proximate the second surface 274 of printhead die 270. In this example, spacers 297 include through holes 298 through which screws can be inserted in order to affix overmolded support structure 290 to printhead chassis 247. Alternatively, spacers can be formed in areas other than surrounding attachment features 291 (FIG. 14). Attachment features can alternatively be discrete members that can be positioned between the elastomeric gasket 288 and the overmolded support structure 290 during assembly of the printhead.

Reinforcing structural features 299 are schematically shown between adjacent printhead die 270 in FIG. 15 for added mechanical strength. Reinforcing structural features 299 can include ribs, gussets or other such structural features and can be molded as part of the overmolded support structure 290.

Having described the features of the printhead 250, a method of assembly will next be described. Although the portion of the prior art configuration of FIG. 2 near printhead die 251 (including mounting assembly 280) is modified in the present invention, other components such as printhead chassis 247 are similar to FIG. 2 in the present invention. The method will be described with reference to FIGS. 2, and 10 to 15. At least one printhead die 270 is provided including at least one nozzle array 253 on a nozzle face surface 285 and corresponding ink feed opening(s) 279 disposed on a second surface 274 opposite the nozzle face surface 285, the ink feed opening(s) 279 being fluidically connected to the corresponding array(s) of nozzles. The at least one printhead die 270 is positioned adjacent to a flexible printed wiring array 257. Optionally the ends of the printhead die 270 are adhered to the flexible printed wiring array to stabilize their location. Electrical interconnections are made between the printhead die 270 and the flexible printed wiring member 257, for example by wire bonding or by tape automated bonding. A support structure 290 is overmolded to be in contact with the printhead die, the electrical interconnections and a die interconnect portion of the flexible printed wiring member 257. Printhead chassis 247 is provided for example by injection molding. Manifold 210, which also can be provided by injection molding, is affixed to printhead chassis 247, for example by laser welding. The overmolded support structure 290 is affixed to the printhead chassis 247 such that ink feed openings 279 are adjacent the manifold ink outlets 211. A fluidic seal is provided between one or more manifold ink outlets 211 and the corresponding ink feed openings 279 of printhead die 270. The fluidic seal can be an elastomeric gasket 288 that is positioned between the manifold 210 and the printhead die 270 and is compressed when the overmolded support structure 290 is affixed to the printhead chassis 247. Alternatively, the gasket can be formed by dispensing a material, such as a silicone, between the second surface 270 of the printhead die and the manifold 210 before affixing the overmolded support structure 290 to the printhead chassis 247.

In some embodiments the overmolded support structure is affixed to a first side of the printhead chassis 247 and the flexible printed wiring member 257 is bent in order to attach the connector portion of the flexible printed wiring member to a second side 245 of the printhead chassis.

Additional features that can be molded as part of overmolded support structure 290 include a capping surface 292 (proximate the nozzle face surface 285 of printhead die 270), spacers 297, attachment features 291, inclined regions 293, recessed region 296, through holes 298, and reinforcing structural features 299.

Printhead die 270 can be fabricated according to the process described relative to FIG. 10. In particular a planar substrate 271 can be provided including a first interface surface 273 and a channel 272, and a second surface 274 opposite the first interface surface 273. A planar semiconductor member 275 can be provided including a first surface 276 and a second interface surface 277 opposite the first surface 276. The first interface surface 273 of the planar substrate 271 can be fused to the second interface surface 277 of the planar semiconductor member 275. Nozzle array 253 can be formed on the first surface 276 of the planar semiconductor member 275, thereby forming a nozzle face surface 285. Ink feed opening extending from second surface 274 to channel 272 can be formed. In a preferred embodiment, both the planar substrate 271 and the planar semiconductor member are made of silicon. Multiple nozzle arrays 253 can be provided by including multiple nozzle arrays 253 on a single printhead die 270, or by including multiple printhead die 270. Reinforcing structural features can be provided between adjacent printhead die 270 to provide additional mechanical strength.

Embodiments described above include a printhead chassis 247 into which one or more ink tanks can be installed such that the ink supply port 265 of the ink tank makes fluidic connection with the ink inlet port 242 or 248 or the printhead chassis 247 (FIGS. 5 and 6). Other embodiments can be used for so-called "off-axis" ink delivery, where the ink is provided to the printhead from a supply that does not move together with the carriage. In such embodiments there is preferably a manifold to facilitate connection of off-axis ink supplies at a relatively wide spacing to the narrow spacing of the nozzle arrays. However, such embodiments might not include a printhead chassis as described above.

Advantages of the invention include (but may not be limited to) the following: improved control of encapsulant near the nozzle face is provided; fewer different materials are used, which can help compatibility and cost; and relatively expensive components and processes are eliminated, such as the ceramic mounting member for the printhead die and the precision dispensing of die bonding adhesive.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First ink source
19 Second ink source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array

131 Nozzle(s)
132 Ink delivery pathway (for second nozzle array)
181 Droplet(s) (ejected from first nozzle array)
182 Droplet(s) (ejected from second nozzle array)
200 Carriage
210 Manifold
211 Manifold ink outlet
212 Manifold entry port
213 Manifold ink path
222 Flexible base layer
224 Contact pad(s)
225 Leads
226 Connector pad(s)
227 Cover layer
228 Opening (in flexible printed wiring member)
229 Bend region
230 Ink entry surface (of mounting substrate)
231 Ink entry opening (of mounting substrate)
232 Die attach surface (of mounting substrate)
235 Die bond adhesive
236 Elongated opening (of mounting substrate)
241 Multi-chamber ink supply region
242 Multi-chamber ink inlet port
244 Screw(s)
245 Rear side (of printhead chassis)
246 Single-chamber ink supply region
247 Printhead chassis
248 Single-chamber ink inlet port
249 Partitioning wall
250 Printhead
251 Printhead die
252 Ink feed
253 Nozzle array
254 Nozzle array direction
255 Mounting substrate
256 Encapsulant
257 Flexible printed wiring member
258 Connector board
259 Elongated ink feed opening
262 Multichamber ink tank
264 Single chamber ink tank
265 Ink supply port
266 Ink supply body
267 Lid
268 Lid sealing interface
269 Chamber
270 Printhead die (with composite substrate)
271 Planar substrate
272 Channel
273 First interface surface (of planar substrate)
274 Second surface (of planar substrate)
275 Planar semiconductor member
276 First surface (of planar semiconductor member)
277 Second interface surface (of planar semiconductor member)
278 Ink passageway
279 Ink feed opening
280 Mounting assembly
282 Extended portion (of mounting assembly)
284 Alignment features
285 Nozzle face surface
286 Wire bond(s)
287 Bond pad(s)
288 Gasket
289 Gasket opening(s)
290 Overmolded support structure
291 Attachment features
292 Capping surface
293 Inclined region
294 Scanning lead edge(s)
295 Alignment feature(s)
296 Recessed region
297 Spacer(s)
298 Through hole(s)
299 Reinforcing structural feature
300 Printer chassis
301 Platen
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Cap
335 Wiper
370 Stack of media
371 Top piece of medium
380 Carriage motor
382 Carriage guide rail
383 Encoder fence
384 Belt
390 Printer electronics board
392 Cable connectors

The invention claimed is:

1. An inkjet printhead comprising:

a printhead die including an array of nozzles disposed along a nozzle array direction on a first surface, and an ink feed opening disposed on a second surface opposite the first surface, the ink feed opening being fluidically connected to the array of nozzles;

a manifold including an ink outlet and an ink path that is fluidically connected to the ink outlet;

a gasket that provides a fluidic seal between the ink outlet of the manifold and the ink feed opening of the printhead die;

a flexible printed wiring member disposed adjacent the printhead die;

a plurality of electrical interconnections connecting the printhead die to the flexible printed wiring member; and an overmolded support structure in contact with the first surface of the printhead die, the second surface of the printhead die, the flexible printed wiring member and the plurality of electrical interconnections.

2. The inkjet printhead of claim 1 further comprising a spacer disposed adjacent to the manifold.

3. The inkjet printhead of claim 2, wherein the spacer is integrally formed with the overmolded support structure.

4. The inkjet printhead of claim 1 further including a printhead chassis to which the manifold is affixed, wherein the overmolded support structure is affixed to the printhead chassis.

5. The inkjet printhead of claim 1, wherein the overmolded support structure is affixed to the manifold.

6. The inkjet printhead of claim 1, wherein the overmolded support structure has a flat surface to provide a surface for capping.

7. The inkjet printhead of claim 1, the array of nozzles being a first array of nozzles, the ink feed opening being a first ink feed opening, the ink outlet being a first ink outlet, the ink path being a first ink path, and the gasket being a first gasket, the inkjet printhead further comprising:

a second array of nozzles disposed along the nozzle array direction and offset from the first array of nozzles along a direction perpendicular to the nozzle array direction;

a second ink feed opening that is fluidically connected to the second array of nozzles;

a second ink outlet and a second ink path included in the manifold; and a second gasket that provides a fluidic seal between the second ink outlet of the manifold and the second ink feed opening.

8. The inkjet printhead of claim 7, the first array of nozzles and the second array of nozzles each having a substantially equal nozzle array length along the nozzle array direction, wherein the second ink feed opening is displaced from the first ink feed opening by a distance that is less than 50% of the nozzle array length along the nozzle array direction and by a distance that is less than 30% of the nozzle array length in a direction perpendicular to the nozzle array direction.

9. The inkjet printhead of claim 7, wherein the first gasket and the second gasket are integrally formed together as a single part.

10. The inkjet printhead of claim 7, wherein the second array of nozzles and the second ink feed opening are disposed on the same printhead die as the first array of nozzles.

11. The inkjet printhead of claim 7, the printhead die being a first printhead die, the inkjet printhead further comprising a second printhead die including a second array of nozzles disposed along the nozzle array direction on a first surface, and a second ink feed opening disposed on a second surface opposite the first surface, the second ink feed opening being fluidically connected to the second array of nozzles.

12. The inkjet printhead of claim 7, wherein the second ink inlet port is separated from the first ink inlet port of the printhead chassis by a distance that is greater than a distance between the second ink outlet and the first ink outlet of the manifold.

13. An inkjet printhead comprising:

a printhead die including an array of nozzles disposed along a nozzle array direction on a first surface, the nozzle array having a length along the nozzle array direction, and an ink feed opening disposed on a second surface opposite the first surface, the ink feed opening being fluidically connected to the array of nozzles; wherein no dimension of the ink feed opening is greater than 20% of the length of the nozzle array;

a manifold including an ink outlet and an ink path that is fluidically connected to the ink outlet; and a gasket that provides a fluidic seal between the ink outlet of the manifold and the ink feed opening of the printhead die.

14. An inkjet printer comprising:

an ink supply;

an inkjet printhead comprising:

a printhead die including an array of nozzles disposed along a nozzle array direction on a first surface, and an ink feed opening disposed on a second surface opposite the first surface, the ink feed opening being fluidically connected to the array of nozzles;

a manifold including an ink outlet and an ink path that is fluidically connected to the ink outlet;

a gasket that provides a fluidic seal between the ink outlet of the manifold and the ink feed opening of the printhead die;

a flexible printed wiring member disposed adjacent the printhead die;

a plurality of electrical interconnections connecting the printhead die to the flexible printed wiring member; and an overmolded support structure in contact with the first surface of the printhead die, the second surface of the printhead die, the flexible printed wiring member and the plurality of electrical interconnections; and a maintenance station including a cap for capping the inkjet printhead.

15. The inkjet printer of claim 14 further comprising a printhead chassis, wherein the overmolded support structure is affixed to the printhead chassis.

16. The inkjet printer of claim 15, wherein the ink supply is detachably mountable on the printhead chassis.

17. The inkjet printer of claim 14, wherein the overmolded support structure has a flat surface to provide a surface for capping by the cap of the maintenance station.

18. The inkjet printer of claim 17, wherein the first surface of the printhead die is recessed relative to the flat surface of the overmolded support structure.

19. The inkjet printer of claim 14 further comprising datum features for aligning the inkjet printhead, wherein the overmolded support structure includes alignment features corresponding to the datum features.

20. The inkjet printer of claim 14, the array of nozzles being a first array of nozzles, the ink feed opening being a first ink feed opening, the ink outlet being a first ink outlet, the ink path being a first ink path, and the gasket being a first elastomeric gasket, and the ink supply being a first ink supply, the inkjet printer further comprising:

a second array of nozzles disposed along the nozzle array direction and offset from the first array of nozzles along a direction perpendicular to the nozzle array direction;

a second ink feed opening that is fluidically connected to the second array of nozzles;

a second ink outlet and a second ink path included in the manifold; and a second gasket that provides a fluidic seal between the second ink outlet of the manifold and the second ink feed opening.

21. The inkjet printer of claim 20, the first array of nozzles and the second array of nozzles each having a substantially equal nozzle array length along the nozzle array direction, wherein the second ink feed opening is displaced from the first ink feed opening by a distance that is less than 50% of the nozzle array length along the nozzle array direction and by a distance that is less than 30% of the nozzle array length in a direction perpendicular to the nozzle array direction.

22. The inkjet printer of claim 20, wherein the first gasket and the second gasket are integrally formed together as a single part.

23. The inkjet printer of claim 20, wherein the second array of nozzles and the second ink feed opening are disposed on the same printhead die as the first array of nozzles.

24. The inkjet printhead of claim 20, wherein the second ink inlet port is separated from the first ink inlet port of the printhead chassis by a distance that is greater than a distance between the second ink outlet and the first ink outlet of the manifold.

25. The inkjet printer of claim 20, the printhead die being a first printhead die, the inkjet printhead further comprising a second printhead die including a second array of nozzles disposed along the nozzle array direction on a first surface, and a second ink feed opening disposed on a second surface opposite the first surface, the second ink feed opening being fluidically connected to the second array of nozzles.

26. The inkjet printer of claim 25, the inkjet printhead further comprising:

a flexible printed wiring member disposed adjacent the first printhead die and the second printhead die;

a plurality of electrical interconnections connecting the first printhead die and the second printhead die to the flexible printed wiring member; and an overmolded support structure in contact with the first printhead die, the second printhead die, the flexible printed wiring member and the plurality of electrical interconnections.

27. The inkjet printer of claim 26, wherein the overmolded support structure includes a reinforcing structural feature molded between the first printhead die and the second printhead die.

28. An inkjet printer comprising:

an inkjet printhead comprising:

a printhead die including an array of nozzles disposed along a nozzle array direction on a first surface, the nozzle array having a length along the nozzle array direction, and an ink feed opening disposed on a second surface opposite the first surface, the ink feed opening being fluidically connected to the array of nozzles; wherein no dimension of the ink feed opening is greater than 20% of the length of the nozzle array;

a manifold including an ink outlet and an ink path that is fluidically connected to the ink outlet;

a gasket that provides a fluidic seal between the ink outlet of the manifold and the ink feed opening of the printhead die; and a maintenance station including a cap for capping the inkjet printhead.

* * * * *